US009000296B2

(12) United States Patent
Mueller et al.

(10) Patent No.: US 9,000,296 B2
(45) Date of Patent: Apr. 7, 2015

(54) ELECTRONICS FRAME WITH SHAPE MEMORY SEAL ELEMENTS

(71) Applicants: Stephan Mueller, Low er Saxony (DE); Ingo Roders, Seelze (DE); Rene Schulz, Saxony (DE); Robert Buda, Lower Saxony (DE); Henning Rahn, Niedersahcsen (DE); Detlev Benedict, Celle (DE)

(72) Inventors: Stephan Mueller, Low er Saxony (DE); Ingo Roders, Seelze (DE); Rene Schulz, Saxony (DE); Robert Buda, Lower Saxony (DE); Henning Rahn, Niedersahcsen (DE); Detlev Benedict, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 111 days.

(21) Appl. No.: 13/923,833

(22) Filed: Jun. 21, 2013

(65) Prior Publication Data

US 2014/0374167 A1 Dec. 25, 2014

(51) Int. Cl.
*H05K 5/06* (2006.01)
*E21B 17/00* (2006.01)

(52) U.S. Cl.
CPC ..... *E21B 17/003* (2013.01)

(58) Field of Classification Search
CPC ..... H05K 5/061
USPC ..... 174/17.06, 564; 277/644, 646
See application file for complete search history.

(56) References Cited

U.S. PATENT DOCUMENTS

| | | | | |
|---|---|---|---|---|
| 2,527,908 | A * | 10/1950 | Blitz | 174/9 F |
| 4,515,213 | A | 5/1985 | Rogen et al. | |
| 4,588,029 | A | 5/1986 | Blizzard | |
| 4,619,320 | A | 10/1986 | Adnyana et al. | |
| 4,969,598 | A | 11/1990 | Garris | |
| 5,040,283 | A | 8/1991 | Pelgrom | |
| 5,259,554 | A | 11/1993 | Ewing et al. | |
| 5,397,053 | A | 3/1995 | Ewing et al. | |
| 5,539,151 | A * | 7/1996 | Hamzehdoost et al. | 174/564 |
| 5,625,536 | A * | 4/1997 | Soyano et al. | 361/736 |
| 5,709,021 | A | 1/1998 | DiCello et al. | |
| 5,807,189 | A | 9/1998 | Martin et al. | |

(Continued)

FOREIGN PATENT DOCUMENTS

| | | | |
|---|---|---|---|
| CA | 2175790 | A1 | 5/1995 |
| CA | 2379705 | A1 | 11/2000 |

(Continued)

OTHER PUBLICATIONS

"Smart metals' providing actuation, sealing, and connection functions downhole", Leonard Le Blanc, Jan. 1, 2012, Retrieved from http://www.offshore-mag.com/articles/print/volume-62/issue-1/news/part-ii-smart-metals-providing-actuation-sealing-and-connection-functions-downhole.html, 5 pages.

(Continued)

*Primary Examiner* — Hung V Ngo
(74) *Attorney, Agent, or Firm* — Cantor Colburn LLP

(57) ABSTRACT

An electronics frame for a wired pipe drill string, including a housing arranged to be disposed within the wired pipe drill string. The housing includes a chamber formed therein and one or more electronic components disposed in the chamber. A shape memory element is disposed in the chamber. The shape memory element is transitionable in response to a transition stimulus between a first shape permitting positioning within the chamber and a second shape sealingly engagable with the housing to isolate the one or more electronic components from fluid. A method of isolating an electronic component is also included.

20 Claims, 2 Drawing Sheets

(56) References Cited

U.S. PATENT DOCUMENTS

| | | | | |
|---|---|---|---|---|
| 5,866,853 | A * | 2/1999 | Sheehan | 174/653 |
| 6,053,992 | A | 4/2000 | Wu et al. | |
| 6,062,315 | A | 5/2000 | Reinhardt | |
| 6,258,182 | B1 | 7/2001 | Schetky et al. | |
| 6,362,951 | B1 * | 3/2002 | Moribe et al. | 361/600 |
| 6,375,458 | B1 | 4/2002 | Moorleghem et al. | |
| 6,419,358 | B1 | 7/2002 | Schetky et al. | |
| 6,742,585 | B1 | 6/2004 | Braithwaite et al. | |
| 6,799,357 | B2 | 10/2004 | Webb et al. | |
| 7,270,188 | B2 | 9/2007 | Cook et al. | |
| 7,677,321 | B2 | 3/2010 | Spray | |
| 7,943,868 | B2 * | 5/2011 | Anders et al. | 174/564 |
| 8,276,670 | B2 | 10/2012 | Patel | |
| 8,360,161 | B2 | 1/2013 | Buytaert et al. | |
| 2003/0110825 | A1 | 6/2003 | Webb et al. | |
| 2003/0120181 | A1 | 6/2003 | Toma et al. | |
| 2004/0194970 | A1 | 10/2004 | Eatwell et al. | |
| 2006/0199330 | A1 | 9/2006 | Nakamura et al. | |
| 2008/0115772 | A1 * | 5/2008 | Kuperus | 123/513 |
| 2008/0264647 | A1 | 10/2008 | Li | |
| 2008/0296014 | A1 | 12/2008 | Richard et al. | |
| 2009/0173493 | A1 | 7/2009 | Hutin et al. | |
| 2010/0006303 | A1 | 1/2010 | Garcia et al. | |
| 2010/0097890 | A1 | 4/2010 | Sullivan et al. | |
| 2010/0236794 | A1 | 9/2010 | Duan et al. | |
| 2011/0048692 | A1 | 3/2011 | Ross et al. | |
| 2012/0312561 | A1 | 12/2012 | Hallundbaek et al. | |
| 2013/0048289 | A1 | 2/2013 | Mazyar et al. | |

FOREIGN PATENT DOCUMENTS

| | | | |
|---|---|---|---|
| CA | 2460064 | A1 | 3/2003 |
| CA | 2460064 | C | 3/2003 |
| CA | 2489431 | A1 | 1/2004 |
| CA | 2489432 | A1 | 1/2004 |
| CA | 2493120 | A1 | 2/2004 |
| CA | 2175790 | C | 10/2004 |
| DE | 3936927 | A1 | 2/1991 |
| DE | 69604826 | T2 | 4/2000 |
| DE | 69331765 | T2 | 8/2002 |
| DE | 112005001073 | T5 | 5/2007 |
| DE | 60224290 | T2 | 5/2008 |
| EP | 0413900 | A2 | 2/1991 |
| EP | 0727061 | A1 | 8/1996 |
| EP | 0727061 | A4 | 2/1998 |
| EP | 0870117 | A1 | 10/1998 |
| EP | 0870117 | B1 | 10/1999 |
| EP | 1062374 | A1 | 12/2000 |
| EP | 0727061 | B1 | 3/2002 |
| EP | 1427550 | A1 | 6/2004 |
| EP | 1450877 | A2 | 9/2004 |
| EP | 1062374 | A4 | 12/2004 |
| EP | 1516070 | A1 | 3/2005 |
| EP | 1516071 | A1 | 3/2005 |
| EP | 1427550 | A4 | 4/2005 |
| EP | 1539033 | A1 | 6/2005 |
| EP | 1516070 | A4 | 7/2005 |
| EP | 1516071 | A4 | 11/2005 |
| EP | 1608416 | A1 | 12/2005 |
| EP | 1706517 | A2 | 10/2006 |
| EP | 1713943 | A1 | 10/2006 |
| EP | 1729920 | A1 | 12/2006 |
| EP | 1841487 | A1 | 10/2007 |
| EP | 1427550 | B1 | 12/2007 |
| EP | 1608416 | B1 | 1/2009 |
| EP | 2436874 | A1 | 4/2012 |
| FR | 2651296 | A1 | 3/1991 |
| GB | 2235309 | A | 2/1991 |
| WO | 9214083 | A1 | 8/1992 |
| WO | 9512839 | A1 | 5/1995 |
| WO | 9720602 | A1 | 6/1997 |
| WO | 9945161 | A1 | 9/1999 |
| WO | 0026501 | A1 | 5/2000 |
| WO | 03024639 | A1 | 3/2003 |
| WO | 03039623 | A2 | 5/2003 |
| WO | 03039623 | A3 | 5/2003 |
| WO | 2004003242 | A1 | 1/2004 |
| WO | 2004003243 | A1 | 1/2004 |
| WO | 2004014254 | A1 | 2/2004 |
| WO | 2004018833 | A1 | 3/2004 |
| WO | 2004091680 | A1 | 10/2004 |
| WO | 2005087434 | A1 | 9/2005 |
| WO | 2005093109 | A1 | 10/2005 |
| WO | 2005098064 | A2 | 10/2005 |
| WO | 2005098064 | A3 | 10/2005 |
| WO | 2005112783 | A1 | 12/2005 |
| WO | 2006007434 | A1 | 1/2006 |
| WO | 2006078969 | A1 | 7/2006 |

OTHER PUBLICATIONS

Notification of Transmittal of the International Search Report and the Written Opinion of the International Searching Authority, or the Declaration; PCT/US2014/042921; Mail date: Oct. 8, 2014, 16 pages.

* cited by examiner

ELECTRONICS FRAME WITH SHAPE MEMORY SEAL ELEMENTS

BACKGROUND

Seals and sealed components are ubiquitous in the downhole drilling and completions industry and used for a variety of applications. One example includes protecting devices, mechanisms, or other components from fluids or fluid pressure by encapsulating or isolating the components within a sealed chamber, pocket, or area. Although currently known systems work sufficiently for their intended purposes, each is not without tradeoffs and the industry would well receive additional alternative seal arrangements.

SUMMARY

An electronics frame for a wired pipe drill string, comprising a housing arranged to be disposed within the wired pipe drill string, the housing including a chamber formed therein; one or more electronic components disposed in the chamber; and a shape memory element disposed in the chamber, the shape memory element transitionable in response to a transition stimulus between a first shape permitting positioning within the chamber and a second shape sealingly engagable with the housing to isolate the one or more electronic components from fluid.

A method of isolating an electronic component of an electronics frame for a wired pipe drill string, comprising disposing a shape memory element in a chamber formed in a housing of the electronics frame, the shape memory element having a first shape, the first shape enabling positioning of the shape memory element within the chamber; exposing the shape memory element to a transition stimulus in order to trigger a transition of the shape memory element to a second shape, the second shape enabling engagement between the shape memory element and the housing within the chamber; and isolating an electronics component disposed in the chamber from fluid due to the engagement of the shape memory element with the housing.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
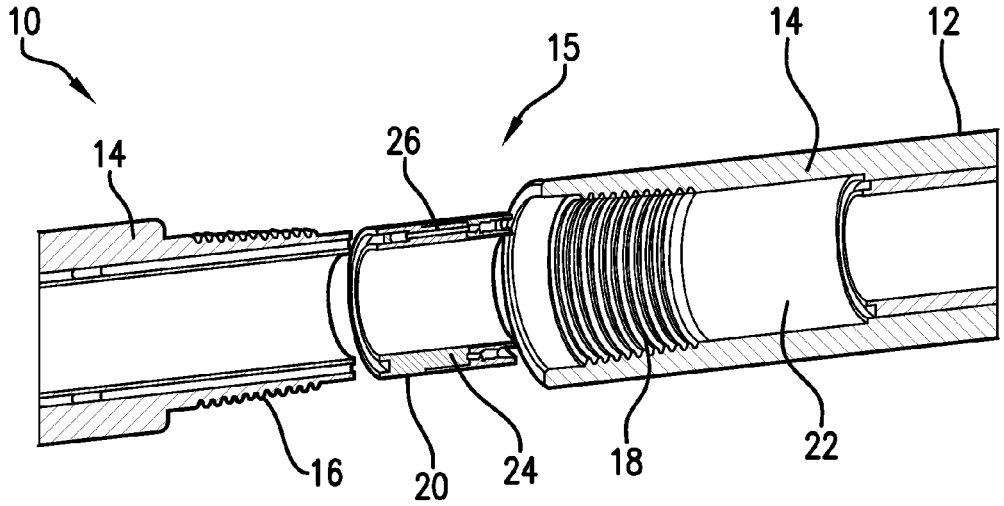
FIG. 1 is an exploded cross-sectional view of a system having an electronics frame disposable with a coupling assembly between two tubular segments.

Referring to FIG. 1, an exemplary embodiment of a portion of a well drilling, logging, completion and/or production system 10. The system 10 includes a conduit or string 12, namely a drill string, which is configured to be disposed in a borehole for performing operations such as drilling the borehole, making measurements of properties of the borehole and/or the surrounding formation downhole, and facilitating hydrocarbon production. Accordingly, with respect to the embodiments disclosed herein, the system 10 is accordingly referred to as a borehole completion system.

The string 12 includes at least a pair of string components, such as tubular or pipe segments or components 14 and a coupling assembly 15 for connecting together each adjacent pair of the segments 14 as the string 12 is run into a borehole. Each of the segments 14 has a first coupling mechanism 16 at one end and a second coupling mechanism 18 at a second end to form the coupling assembly 15. An inner bore or other conduit extends along the length of each segment 14 to allow drilling mud or other fluids to flow through the string 12 when assembled by connecting the segments 14 together. Although the string component is described as a pipe segment, it is not so limited. The string components may be any type of downhole component that includes a coupling mechanism for coupling the components together, including any device, device component, combination of devices, media and/or member that may be used to convey, house, support or otherwise facilitate the use of another device, device component, combination of devices, media and/or member. Non-limiting examples include wireline or logging-while-drilling tools, wire pipe, drill strings of the jointed pipe type, casing pipes, and any combination or portion thereof.

In the illustrated embodiment, the first coupling mechanism 16 is arranged as a male coupling having an exterior threaded section, and may be referred to herein as the "pin" 16. The second coupling mechanism 18 is arranged as a female coupling having an interior threaded section, and may be referred to herein as the "box" 18. The pin 16 and the box 18 are configured so that the pin 16 can be disposed within the box 18 to enable a fixed connection therebetween to connect an adjacent pair of the segments 14 or other downhole components. In one embodiment, the exterior of the pin 16 and the interior of the box 18 are tapered along their lengths to facilitate coupling. Although the pin 16 and the box 18 are described has having threaded portions, the pin 16 and the box 18 may be configured to be coupled using any suitable mechanism, such as bolts or screws or an interference fit.

In the illustrated embodiment, the system 10 includes an electronics frame 20 disposed with the coupling mechanisms 16 and 18 of the assembly 15. In one embodiment, the electronics frame 20 includes electronics configured to facilitate wired pipe telemetry or other communications through the string 12, when it is arranged as a wired pipe drill string. In one embodiment, the frame 20 is a pressure-sealed and mechanically robust electronics frame configured to be disposed within the coupling assembly 15 between the downhole components 14, e.g., within a space 22 formed within and/or between the pin 16 and/or the box 18.

As demonstrated in FIG. 1, in some embodiments, the frame 20 is separate and removable from the coupling assembly 10 and is shaped or otherwise configured to sit within a portion of the coupling assembly 10 and held axially in place by the coupling assembly 10 without requiring any additional connection or securing features. Specifically, FIG. 1 shows the frame 20 being disposed or mounted within the space 22, which is illustrated in the form of an elongated box bore-back. That is, the space 22 is formed similarly to a typical bore-back, i.e., having a reduction of internal diameter behind the threaded portion of the box of a tubular or pipe segment, e.g., in order to reduce stress concentrations during static and dynamic loading, but with the space 22 being longitudinally elongated with respect to a typical bore-back in order to accommodate the positioning of the frame 20 therein. In one embodiment, the frame 20 is not adhered to or rotationally fixed within the space 22, although the frame 20 can be adhered or fixed if desired.

Figure 2:
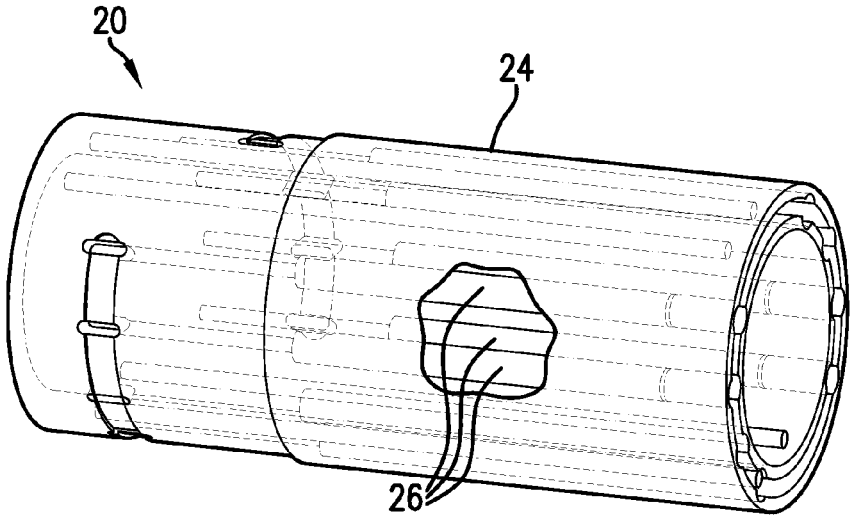
FIG. 2 is a perspective view of an electronics frame according to one embodiment disclosed herein.

As shown in FIG. 2, the frame 20 is configured with a housing 24 having one or more chambers 26. The housing 24 could be formed from a single piece or multiple pieces joined together. The chambers 26 are arranged to contain one or more associated electronic components, e.g. a component 28 shown in FIG. 3. The chambers 26 could be formed as passages, recesses, bores, channels, pockets, cavities, or any other opening or void configured to house one or more electronic components. One or more of the components 28 could be included in each of the chambers 26. Examples of the electronic components 28 include repeater electronics of a signal transmission system configured to transmit power and/or communications between downhole components. Such exemplary repeater components include batteries, control electronics such as multi-chip modules (MCMs), signal coupling elements such as coupler rings, antennas, electrical contacts and inductive coupling elements, etc. The signal coupling element may be of any suitable type, such as an inductive coil, direct electrical contacts, optical connection ring, etc. Other examples for the components 28 that may be housed in the chambers 26 include transmission components such as antenna connectors and/or interfaces and various sealing components such as glass seals and antenna seals, processing chips, sensors, cables, wires, optical fibers, etc. The embodiments shown in the Figures are exemplary and are not provided to limit the electronic frame 20 to any particular configuration. The number, shape and type of channels 26 are not limited. In addition, the electronic components 28 are not limited, and may be for example any suitable components provided to facilitate communication or transmission between downhole components.

Figure 3:
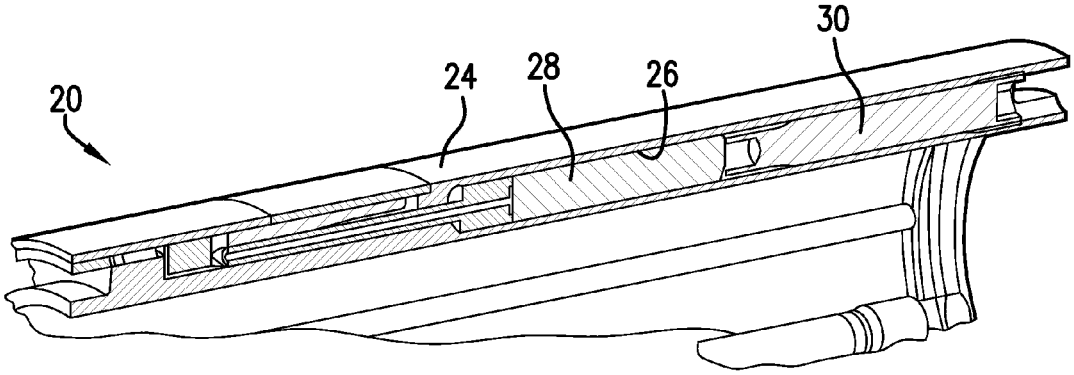
FIG. 3 is a partial cross-sectional view showing a chamber of an electronics frame housing an electronics component and being sealed by a shape memory element according to one embodiment disclosed herein.

In order to protect the electronic components 28 from fluids and fluid pressure within the string 12, e.g., drilling mud, production fluids, borehole treatment fluids, etc., each of the chambers 26 can be sealed by a shape memory element 30 as shown in FIG. 3. In one embodiment the fluid pressure is hydrostatic pressure of fluid contained within the string 12, while in another embodiment the fluid is pressurized by a pump or the like, e.g., for performing a tool actuation operation, borehole treatment, etc. The shape memory elements 30 are generally arranged to transition between two or more shapes. A first shape is relatively smaller than the chambers 26 in order to enable the elements 30 to be positioned within the chambers 26, while a second shape of the elements 30 is expanded in at least one direction, e.g., radially, in order to seal the elements 30 within their respective ones of the chambers 26. Generally, the shape memory elements 30 "remember" a default shape and revert to that shape (e.g., the second shape noted above) upon exposure to a corresponding transition stimulus. In transitioning to the remembered or default shape, the elements 30 change dimension, e.g., radially, and plug, block, impede, or otherwise seal off the chambers 26.

Figure 4:
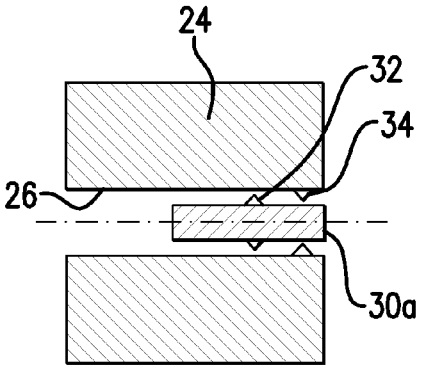
FIG. 4 is a schematic cross-sectional view of a shape memory element in a first shape positioned with in a chamber of a housing.
Figure 5:
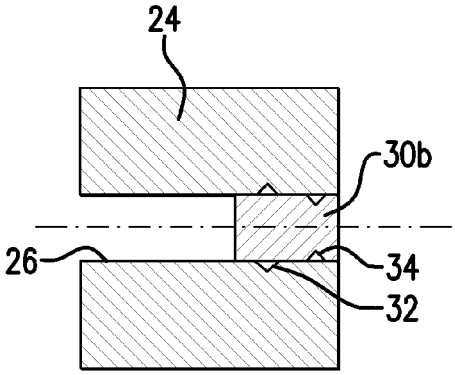
FIG. 5 is a schematic cross-sectional view of the frame of FIG. 4 with the shape memory element in a second shape that enables the chamber to be sealed by the shape memory element.

Use of the elements 30 can be better appreciated in view of the example of FIGS. 4 and 5. In the example of FIG. 4, a shape memory element having a first shape, generally denoted with the numeral 30*a*, is positioned within one of the chambers 26 of the housing 24. The shape memory element undergoes a shape memory change, transitioning to a second shape, generally denoted with the numeral 30*b*. The first shape 30*a* is radially thinner than the second shape 30*b*, enabling the shape memory element to be inserted into and/or removed from the chamber 26. The second shape 30*b*, e.g., the remembered or default shape, is radially enlarged in comparison to the first shape 30*a* in order to sealingly engage with the housing 24 to seal the chamber 26.

In one embodiment, the transition stimulus relates to heating the elements 30 above a threshold transition temperature, although any other transition stimulus known or discovered can be used with corresponding shape memory materials. When exposed to its corresponding transition stimulus, e.g., heat, reversion of the shape memory element 30 to its remembered or default shape (the "second shape" as referred to herein) will occur. In one embodiment, removal of the transition stimulus, e.g., cooling the elements 30, will cause the elements 30 to again at least partially change shape (e.g., revert back to the first shape that is relatively smaller than the chambers 26 and enables the elements 30 to be positioned within the chambers 26). In one embodiment, the shape memory element 30 is a shape memory alloy. In a further embodiment, the shape memory alloy is a combination of nickel (Ni) and titanium (Ti). Those of ordinary skill in the art will recognize any number of other materials that exhibit shape memory change and are suitable for use in the embodiments disclosed herein, e.g., shape memory polymers, shape memory composites, other shape memory alloys, etc.

As illustrated in FIGS. 4 and 5, the shape memory elements 30 can include one or more sealing features 32 and/or the chambers 26 can include one or more sealing features 34. In one embodiment the sealing features 32 and/or 34 are arranged as ridges, teeth, bumps, projections, protrusions, etc. or other geometric structures or recesses, grooves, etc. corresponding thereto, or combinations thereof for improving the engagement of the shape memory elements 30 within the chambers 26. In one embodiment the features 32 and/or 34 facilitate a metal to metal seal when the housing is metal and the elements 30 are shape memory alloys. In another embodiment, the features 32 and/or 34 take the form of elastomeric elements that are sealingly engaged with the housing 24 when the shape memory elements 30 expand within the chambers 26. There can be any number of the features 32 and/or 34, and the features 32 and/or 34 could take any shape or form desired in order to improve the engagement between the elements 30 and the chambers 26.

Some previous electronics frames utilized welds to permanently encapsulate the electronic components between various housing parts, e.g., inner and outer sleeves or the like. The use of the shape memory elements 30 advantageously avoids the need to use welds to sealingly encapsulate the electronic components 28 within the chambers 26. The high temperatures involved in welding increases the risk of damage or reduction in efficiency, effectiveness, or lifespan of electronic components. Although heat/temperature is used as the transition stimulus for enabling a shape change of the elements 30 in one embodiment, the specific shape memory material of the elements 30 can be selected such that the threshold transition temperature is less than that required by welding operations. In this way, the electronic components 28 can be protected from relatively high and potentially damaging temperatures. Of course, welding could still be utilized in assembling the frame 20 and/or temperatures used that exceed those required by welding operations. In one embodiment, components of the frame 20 are welded together and the heat of welding simultaneously triggers the shape change of the elements 30. It is of course to be understood that heat can alternatively be provided via a heated fluid, heating device such as a hot air gun, etc.

In one embodiment, the shape memory elements 30 have two "remembered" shapes, i.e., the shape memory elements 30 exhibit two-way shape memory change with both the first and second shapes being remembered shapes. In this way the elements 30 can be "deactivated" by removing the transition stimulus, e.g., cooling the elements 30 below the threshold transition temperature. In this way, the elements 30 can be removed and the electronic components 28 readily accessed if desired. For example, in one embodiment the electronic components 28 include batteries and a two-way shape change material is used for the elements 30 to enable the batteries to be changed after retrieval of the frame 20 such that the frame 20 can be reused in the same or another borehole. The use of two-way shape memory materials for the elements 30 also enable other components to be accessed, e.g., for replacement or repair, thereby increasing the lifespan and usefulness of the frame 20.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. An electronics frame for a wired pipe drill string, comprising:

a housing arranged to be disposed within the wired pipe drill string, the housing including a chamber formed therein;

one or more electronic components disposed in the chamber; and a shape memory element disposed in the chamber, the shape memory element transitionable in response to a transition stimulus between a first shape permitting positioning within the chamber and a second shape sealingly engagable with the housing to isolate the one or more electronic components from fluid.

2. The electronics frame of claim 1, further comprising a sealing feature located in the chamber and disposed between the shape memory element and the housing.

3. The electronics frame of claim 2, wherein the sealing feature is included by the shape memory element.

4. The electronics frame of claim 2, wherein the sealing feature is included by the housing at a surface of the chamber.

5. The electronics frame of claim 2, wherein the sealing feature is a geometric structure located in the chamber and projecting radially between the shape memory element and the housing.

6. The electronics frame of claim 1, wherein the shape memory element comprises a shape memory alloy.

7. The electronics frame of claim 6, wherein the shape memory alloy includes nickel and titanium.

8. The electronics frame of claim 1, wherein the transition stimulus includes heating the shape memory element above a threshold temperature.

9. The electronics frame of claim 1, wherein the threshold temperature is less than or equal to that required to perform a welding operation on the housing.

10. The electronics frame of claim 1, wherein the threshold temperature is more than that required to perform a welding operation on the housing.

11. The electronics frame of claim 1, wherein the one or more electronic components facilitate wired pipe telemetry.

12. The electronics frame of claim 1, wherein the one or more electronic components include one or more batteries, repeater components, antennas, or a combination including at least one of the foregoing.

13. A coupling assembly including an electronics frame according to claim 1 disposed in a space between an adjacent pair of tubular components.

14. The coupling assembly of claim 13, wherein one of the tubular components includes a pin and another of the tubular components includes a box couplable with the pin.

15. The coupling assembly of claim 14, wherein the space is an elongated bore-back formed in the box.

16. A method of isolating an electronic component of an electronics frame for a wired pipe drill string, comprising:

disposing a shape memory element in a chamber formed in a housing of the electronics frame, the shape memory element having a first shape, the first shape enabling positioning of the shape memory element within the chamber;

exposing the shape memory element to a transition stimulus in order to trigger a transition of the shape memory element to a second shape, the second shape enabling engagement between the shape memory element and the housing within the chamber; and isolating an electronics component disposed in the chamber from fluid due to the engagement of the shape memory element with the housing.

17. The method of claim 16, further comprising disposing the electronics frame within a coupling assembly between a pair of adjacent tubular components.

18. The method of claim 16, wherein exposing the shape memory element includes heating the shape memory element above a threshold transition temperature.

19. The method of claim 16, further comprising installing the electronics frame in a space between two sections of the drill string.

20. The method of claim 19, further comprising running the drill string downhole.

* * * * *